US006103026A

United States Patent [19]

Yoshino et al.

[11] Patent Number: 6,103,026

[45] Date of Patent: Aug. 15, 2000

[54] CORROSION-RESISTANT COPPER MATERIALS AND MAKING METHOD

[75] Inventors: Masachika Yoshino; Toshio Shiobara, both of Gunma-ken; Naoya Noguchi, Annaka, all of Japan

[73] Assignee: Shin-Etsu Chemical Co., Ltd., Tokyo, Japan

[21] Appl. No.: 09/054,448

[22] Filed: Apr. 3, 1998

[30] Foreign Application Priority Data

Apr. 3, 1997 [JP] Japan ..... 9-100889

[51] Int. Cl.[7] ..... C22C 9/00

[52] U.S. Cl. ..... 148/432; 148/279; 148/282; 148/687; 148/433; 148/434; 148/435; 428/547; 428/674; 427/255.1; 427/399

[58] Field of Search ..... 148/282, 279, 148/687, 432, 433, 434, 435; 427/255.1, 399; 428/547, 674

[56] References Cited

U.S. PATENT DOCUMENTS 4,822,642 4/1989 Cabrera et al. ..... 427/255.1

OTHER PUBLICATIONS

Li, Jian et al, *J. Appl. Phys.*, 70(5), pp. 2820–2827 (1991), Oxidation and Protection in Copper and Copper Alloy Thin Films.

C. Lee et al., 1st Electronic Packaging Technology Conference, pp. 201–207, 1997, The Role of Surface Morphology on Interfacial Adhesion in IC Packaging.

T. Sato et al., Japan Electric Material Association, 34th Lecture in Autumn, (1997) (partial translation).

*Primary Examiner*—Sikyin Ip
*Attorney, Agent, or Firm*—Birch, Stewart, Kolasch & Birch, LLP

[57] ABSTRACT

A corrosion-resistant copper material has a surface layer of a copper alloy containing 10–50 at % (i.e. % by atom) of silicon and of 10–1,000 Å thick. It is produced simply by annealing a copper material containing 0.01–5 at % of silicon at 100–600° C. in a hydrogen-containing gas. Because of its excellent resistance to surface corrosion due to heat and aging, the resulting copper material lends itself well to automotive and electrical applications requiring heat resistance, and is also suitable for use in electrical wire and in leadframes for semiconductor devices.

16 Claims, No Drawings

CORROSION-RESISTANT COPPER MATERIALS AND MAKING METHOD

BACKGROUND OF THE INVENTION

1. Field of the Invention

The present invention relates to corrosion-resistant copper materials which undergo substantially no surface corrosion or oxidative deterioration due to heat or aging, and to a method for the production of the same.

2. Prior Art

Because copper materials are soft, relatively stable metals, they are often used in roofing such as for Shinto shrines and Buddhist temples, and in decorative art, for example. In addition, their high thermal conductivity and electrical conductivity, second only to those of silver, make them indispensable today as metal materials in electrical applications, such as electrical wires and leadframes for semiconductor devices. However, because the copper materials are more reactive than gold and silver, they are readily oxidized and subject to surface corrosion due to heat and aging. For use in automotive and electrical applications requiring heat resistance, they are generally plated with nickel, palladium or the like. But plating with nickel or the like results in a loss in the distinctive reddish tone of copper, and also makes the surface more difficult to work with.

SUMMARY OF THE INVENTION

An object of the present invention is thus to provide a highly stable, corrosion-resistant copper material whose surface is unsusceptible to corrosion due to heat or aging even when not plated. Another object of the invention is to provide a method for preparing the same.

The present inventors have found that when a copper material has at its surface a copper alloy layer containing from 10 to 50 at % (i.e. % by atom) of silicon atoms to a thickness of from 10 to 1,000 angstroms (i.e. $10^{-10}$ m), corrosion of this copper material due to heat and aging is minimized even without the formation of a plating layer of nickel or the like at the surface. Also it was surprising to find that copper material having such a surface layer can be easily produced by annealing a copper material containing from 0.01 to 5 at % of silicon atoms at a temperature of 100 to 600° C. in ambient gas containing at least 0.5% by volume of hydrogen.

The present invention thus provides a corrosion-resistant copper material having a surface layer which consists of a copper alloy containing from 10 to 50 at % of silicon atoms and has a thickness of from 10 to 1,000 angstroms.

The invention also provides a method for producing a corrosion-resistant copper material by annealing a copper material containing from 0.01 to 5 at % of silicon atoms at a temperature of from 100 to 600° C. in an ambient gas having a hydrogen content of at least 0.5% by volume to form at the surface of the copper material a layer which consists of a copper alloy containing from 10 to 50 at % of silicon atoms and has a thickness of from 10 to 1,000 angstroms.

DETAILED DESCRIPTION OF THE INVENTION

The corrosion-resistant copper material of the invention has formed therein a surface layer having a thickness of from 10 to 1,000 angstroms which is composed of a copper alloy containing 10 to 50 at % (i.e. % by atom), preferably 12 to 30 at %, of silicon atoms.

When the silicon atom content of the copper alloy which forms the surface layer is less than 10 at %, it provides less surface corrosion prevention. When the copper alloy has a silicon content of greater than 50 at %, it adversely affects the performance (for example, electrical conductivity and thermal conductivity) of the copper material. The surface layer of copper alloy containing 10 to 50 at % of silicon atoms must have a thickness of at least 10 angstroms as expressed by the perpendicular depth from the surface to the interior of the copper matrix, although a thickness of at least 25 angstroms is preferable and a thickness of at least 50 angstroms is even more preferable. For the purpose of preventing surface corrosion of the copper material, a thickness greater than 1,000 angstroms is superfluous.

In this surface layer of copper alloy containing 10 to 50 at % of silicon atoms, the concentration of silicon atoms need not be uniform. That is, the silicon atom concentration may decrease as one moves from the surface of the layer to the interior of the copper matrix in a perpendicular direction. However, the concentration of silicon atoms must be more than 10 at % (i.e. % by atom) to a depth of at least 10 angstroms from the surface of the layer.

The copper material in portions other than the surface layer may have any of conventional compositions including pure copper and copper alloys containing at least 50 at % of copper. Use may be made of compositions in which the content of elements other than copper is less than 50 at %, preferably from 0 to 45 at %, and especially from 0.001 to 30 at %. Particularly effective alloy compositions include Cu—Ni—Si (Corson) alloys containing 0.01 to 5 at % of silicon atoms. The content of elements other than copper and silicon in the surface layer is preferably from 0 to 45 at %, and more preferably from 0.0001 to 25 at %. Examples of these elements other than copper and silicon include nickel, silver, gold, tin, iron, phosphorus, chromium, zinc, zirconium, magnesium, tellurium, titanium and cobalt.

While it is possible to obtain the corrosion-resistant copper materials of the invention by doping pure copper or silicon-free copper alloys with a metallic silicon liquid, such materials can be obtained with considerable ease by subjecting silicon-containing copper materials such as commercially available Cu—Ni—Si (Corson) copper alloys to conditions as used in the annealing treatment of conventional metals. Commercially available silicon-containing copper materials include OMCL-1 (manufactured by Mitsubishi Shindoh K. K.), KLF-1, KLF-116 and KLF-125 (all manufactured by Kobe Steel, Ltd.), NK164 (Nippon Mining & Metals Co., Ltd.) and C-7025 (Olin Brass).

Because all of these silicon-containing copper materials generally have a silicon atom content of 0.01 to 5 at %, a copper alloy layer having a thickness of 10 to 1,000 angstroms and containing 10 to 50 at % of silicon atoms can easily be formed at the surface of the copper material by carrying out annealing treatment at a temperature of 100 to 600° C. in an ambient gas containing at least 0.5% by volume of hydrogen. Hence, it is advantageous to use a copper alloy containing 0.01 to 5 at %, and especially 0.05 to 3 at %, of silicon atoms as the copper substrate in constructing the copper material of the invention.

The annealing treatment is carried out at a temperature of 100 to 600° C., and especially 200 to 500° C. Annealing temperatures lower than 100° C. are insufficient to form a silicon-rich alloy layer at the surface of the copper material. On the other hand, annealing temperatures higher than 600° C. may induce recrystallization, resulting in a decline in the elongation and other mechanical properties of the copper material.

Annealing is preferably carried out under the above conditions for a period of 30 seconds to 2 hours, and more preferably one minute to one hour. Sufficient annealing does not take place shorter than 30 seconds. More than 2 hours of annealing treatment would increase too much the concentration of silicon atoms in the surface layer, resulting in a decline in the performance as a copper material. As a general rule, copper materials are annealed in order to eliminate hardening due to cold working. In the practice of the invention, this annealing treatment may be carried out in heat treating furnaces of indirect heating or electrical heating system such as roller-hearth annealing furnaces and bell-type annealing furnaces. The atmosphere may be controlled at this time using an ambient gas. The ambient gas used in this invention should have a hydrogen concentration of at least 0.5% by volume, preferably at least 0.8% by volume, and more preferably from 1 to 99.8% by volume, and use may be made of an exothermic ambient gas such as DX gas or NX gas, or an endothermic ambient gas such as AX gas or SAX gas. In some cases, hydrogen gas may be used.

By carrying out annealing treatment at 100 to 600° C. for ½ minute to 2 hours in an ambient gas having a hydrogen content of at least 0.5% by volume, the copper material becomes covered to a depth of at least 10 angstroms from the surface with a copper alloy containing at least 10 at % of silicon atoms. The corrosion-resistant copper materials of the present invention are more readily obtained in this way.

Because of minimal surface corrosion due to heat and aging, the corrosion-resistant copper materials of the present invention are suitable for automotive and electrical applications which require heat resistance. In addition, they can be utilized as electrical wire and are also particularly suitable for use in leadframes for semiconductor devices. These corrosion-resistant copper materials can be easily and reliably manufactured by the production method of the invention.

EXAMPLE

Examples of the invention are given below by way of illustration and not by way of limitation.

Example 1

A Corson-type copper material KLF-1 (manufactured by Kobe Steel, Ltd.; nickel content 3.4 at %, silicon content 1.5 at %, zinc content 0.3 at %) was annealed for 10 minutes at 350° C. in an atmosphere of DX gas containing 8.2 vol % of hydrogen ($CO_2$ 7.0 vol %, CO 10.2 vol %, $CH_4$ 0.5 vol %, $N_2$ 74 vol %).

X-ray wide-scanning spectroscopic analysis of the surface of the resulting copper material revealed a silicon atom content of 28 at %.

The surface 25 angstroms of this copper material (that is the surface region of the copper material perpendicularly extending from the surface to a depth of 25 angstroms) was removed by sputter-etching with argon. X-ray wide-scanning spectroscopic analysis was similarly carried out on the new surface to find a silicon atom content of 15 at %.

This copper material was examined for corrosion resistance by carrying out an accelerated oxidation test in air (in the presence of oxygen) at 200° C. for 4 hours. The surface appearance was visually observed. The results are shown in Table 1.

The copper material was also examined for corrosion resistance in saturated steam by carrying out an accelerated test in a pressure cooker at 120° C. and 100% humidity for 98 hours. The surface appearance was visually observed. The results are shown in Table 1.

Examples 2 to 5

The same copper material KLF-1 as in Example 1 was annealed in an atmosphere of AX gas containing 75 vol % of hydrogen ($N_2$ 25 vol %), under the temperature and time conditions in Table 1.

The resulting copper materials were surface analyzed by x-ray wide-scanning spectroscopy. In addition, the surface 25 angstroms of these copper materials (that is the surface region of the copper material perpendicularly extending from the surface to a depth of 25 angstroms) were removed by sputter-etching with argon, and surface analysis was similarly carried out by x-ray wide-scanning spectroscopy. The results are shown in Table 1.

The corrosion resistances of these copper materials were determined by carrying out the same accelerated tests as in Example 1. The results are shown in Table 1.

Example 6

A Corson-type copper material NK164 (manufactured by Nippon Mining & Metals Co., Ltd.; nickel content 1.7 at %, silicon content 0.9 at %, zinc content 0.4 at %) was annealed for 30 minutes at 400° C. in an atmosphere of AX gas containing 75 vol % of hydrogen ($N_2$ 25 vol %).

The-surface of the resulting copper material was analyzed by x-ray wide-scanning spectroscopy. In addition, each of the surface 10 angstroms and 25 angstroms of this copper material (that is the surface region of the copper material perpendicularly extending from the surface to a depth of 10 angstroms or 25 angstroms) was removed by sputter-etching with argon, and surface analysis was similarly carried out by x-ray wide-scanning spectroscopy. The results are shown in Table 1.

The corrosion resistance of this copper material was determined by carrying out the same accelerated tests as in Example 1. The results are shown in Table 1.

Comparative Examples 1 and 2

For the sake of comparison, surface analysis by x-ray wide-scanning spectroscopy was similarly carried out on the same copper materials, KLF-1 and NK164, as in the above examples, although without prior annealing, and also on the respective copper materials obtained by removing the surface 25 angstroms therefrom. The results are shown in Table 1.

The corrosion resistances of these copper materials were determined by carrying out the same accelerated tests as in Example 1. The results are shown in Table 1.

TABLE 1

| | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|
| Substrate copper alloy | KLF-1 | KLF-1 | KLF-1 | KLF-1 | KLF-1 | NK164 | KLF-1 | NK164 |
| Annealing temperature (° C.) | 350 | 250 | 350 | 350 | 500 | 400 | — | — |
| Annealing time (min) | 30 | 60 | 15 | 60 | 1 | 30 | — | — |
| Ambient gas | DX gas | AX gas | AX gas | AX gas | AX gas | AX gas | — | — |
| Surface Si content (at %) | 28 | 21 | 18 | 40 | 35 | 15 | 1 | 0.7 |
| Si content at depth of 25 Å (at %) | 15 | 19 | 10 | 23 | 12 (10*) | 8 | 1 | 0.7 |
| Appearance after accelerated test @ 200° C./4 hours | intact | intact | intact | intact | intact | intact | discolored | discolored |
| Appearance after pressure cooker test @ 120° C./98 hours | intact | intact | intact | intact | intact | intact | discolored | discolored |

*a silicon content at a perpendicular depth of 10 Å from the outer surface
Appearance rating:
Intact: Surface is somewhat reddish and bright, and unchanged in appearance from the copper material prior to accelerated test.
Discolored: Surface is blackish-brown and dull, indicating corrosion.

Appearance rating:

Intact: Surface is somewhat reddish and bright, and unchanged in appearance from the copper material prior to accelerated test.

Discolored: Surface is blackish-brown and dull, indicating corrosion.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A corrosion-resistant copper material having a surface layer which consists of a copper alloy containing from 10 to 50% by atom of silicon atoms and has a thickness of from 10 to 1,000 angstroms.

2. The corrosion-resistant copper material according to claim 1, prepared by a method comprising the step of annealing a copper material containing from 0.1 to 5% by atom of silicon atoms at a temperature of from 100 to 600° C. in an ambient gas having a hydrogen content of at least 0.5% by volume to form at the surface of the copper material a layer which consists of a copper alloy containing from 10 to 50% by atom of silicon atoms and has a thickness of from 10 to 1,000 angstroms.

3. The corrosion-resistant copper material according to claim 1, wherein the content of elements other than copper is less than 50 at %.

4. The corrosion-resistant copper material according to claim 1, wherein the content of elements other than copper is 0 to 45 at %.

5. The corrosion-resistant copper material according to claim 1, wherein the content of elements other than copper is 0.001 to 30 at %.

6. The corrosion-resistant copper material according to claim 1, wherein the copper alloy consists essentially of copper, nickel and silicon.

7. The corrosion-resistant copper material according to claim 6, wherein the copper alloy contains 0.01 to 5 at % of silicon atoms.

8. The corrosion-resistant copper material according to claim 1, wherein the copper alloy contains silicon and at least one of nickel, silver, gold, tin, iron, phosphorus, chromium, zinc, zirconium, magnesium, tellurium, titanium and cobalt.

9. An electrical wire comprising the corrosion-resistant copper material according to claim 1.

10. A leadframe for a semiconductor device comprising the corrosion-resistant copper material according to claim 1.

11. A method for producing a corrosion-resistant copper material, comprising the step of annealing a copper material containing from 0.01 to 5% by atom of silicon atoms at a temperature of from 100 to 600° C. in an ambient gas having a hydrogen content of at least 0.5% by volume to form at the surface of the copper material a layer which consists of a copper alloy containing from 10 to 50% by atom of silicon atoms and has a thickness of from 10 to 1,000 angstroms.

12. The method for producing a corrosion-resistant copper material according to claim 11, wherein the annealing step is performed at 200° C. to 500° C.

13. The method for producing a corrosion-resistant copper material according to claim 11, wherein the annealing step is performed for 30 seconds to 2 hours.

14. The method for producing a corrosion-resistant copper material according to claim 11, wherein the gas contains 8.2 vol % hydrogen, 7.0 vol % $CO_2$, 10.2 vol % CO, 0.5 vol % $CH_4$, and 74 vol % $N_2$.

15. The method for producing a corrosion-resistant copper material according to claim 11, further comprising a sputter-etching step.

16. The method for producing a corrosion-resistant copper material according to claim 11, wherein the gas contains 75 vol % hydrogen and 25 vol % nitrogen.

* * * * *